US007380341B2

(12) United States Patent
Ping

(10) Patent No.: US 7,380,341 B2
(45) **Date of Patent: *Jun. 3, 2008**

(54) FOLDABLE KNIFE

(75) Inventor: Qui Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/471,863

(22) Filed: Jun. 21, 2006

(65) Prior Publication Data

US 2007/0294895 A1 Dec. 27, 2007

(51) Int. Cl.
*B26B 1/02* (2006.01)

(52) U.S. Cl. ..... 30/161; 30/155; 30/156; 30/330

(58) Field of Classification Search ..... 30/155, 30/156, 157, 160, 161, 329, 330, 331, 332, 30/333, 337, 339
See application file for complete search history.

(56) References Cited

U.S. PATENT DOCUMENTS

| | | | |
|---|---|---|---|
| 97,154 | A | 11/1869 | Barnard |
| 493,075 | A | 3/1893 | Evertz |
| 515,045 | A | 2/1894 | Bultzingslowen |
| 584,077 | A | 6/1897 | Jackson |
| 596,096 | A | 12/1897 | Watts |
| 988,068 | A | 3/1911 | Beardsley |
| 1,362,142 | A | 12/1920 | Rohrer |
| 1,444,324 | A | 2/1923 | Brooks |
| 1,706,251 | A | 3/1929 | Perry |
| 1,750,577 | A | 3/1930 | De Bracht |
| 2,134,973 | A | 11/1938 | Harwell |
| 2,265,775 | A | 12/1941 | Mc Namara |
| 2,284,128 | A | 5/1942 | Bush |
| 2,523,575 | A | 9/1950 | Kassel |
| 2,914,850 | A | 12/1959 | Kuhnl |
| 2,980,996 | A | 4/1961 | Beran |
| 3,306,297 | A | 2/1967 | Woorhees |
| 3,568,315 | A | 3/1971 | Smith |
| 3,593,417 | A | 7/1971 | West |
| 3,872,591 | A | 3/1975 | Quenot |
| 4,017,969 | A | 4/1977 | Stnebraker |
| 4,040,181 | A | 8/1977 | Johnson |
| 4,261,104 | A | 4/1981 | Cusovitch |
| 4,347,665 | A | 9/1982 | Glesser |
| 4,442,600 | A | 4/1984 | Felix-Salichow |
| 4,570,341 | A | 2/1986 | Konneker |
| 4,604,805 | A | 8/1986 | Krieger |
| 4,665,615 | A | 5/1987 | Martinez |
| 4,669,188 | A | 6/1987 | Evrell |
| 4,719,700 | A | 1/1988 | Taylor, Jr. |
| 4,805,303 | A | 2/1989 | Gibbs |

(Continued)

FOREIGN PATENT DOCUMENTS

| | | |
|---|---|---|
| CN | 02-2-88379.7 | 12/2002 |

(Continued)

*Primary Examiner*—Hwei-Siu C. Payer
(74) *Attorney, Agent, or Firm*—Joseph J. Previto

(57) ABSTRACT

A foldable knife having a handle and a blade holder movably mounted on the handle for movement from an unfolded position to a folded position. The handle has a space adapted to receive the blade holder when the blade holder is in its folded position. The blade holder has a blade locking mechanism.

14 Claims, 7 Drawing Sheets

U.S. PATENT DOCUMENTS

| | | | | |
|---|---|---|---|---|
| 4,811,486 | A | 3/1989 | Cunningham | |
| 4,920,644 | A | 5/1990 | La Gattuta | |
| 4,936,014 | A | 6/1990 | Shaanan et al. | |
| 5,044,079 | A | 9/1991 | Gibbs | |
| 5,095,624 | A | 3/1992 | Ennis | |
| 5,125,157 | A | 6/1992 | Howard | |
| 5,400,509 | A | 3/1995 | Collins | |
| 5,511,310 | A | 4/1996 | Sessions | |
| 5,769,094 | A | 6/1998 | Jenkins | |
| 5,815,927 | A | 10/1998 | Collins | |
| 6,354,007 | B1 | 3/2002 | Scarla | |
| 6,367,154 | B2 * | 4/2002 | Degabli | 30/123 |
| 6,446,341 | B1 | 9/2002 | Wang | |
| 6,487,740 | B2 | 12/2002 | Seber | |
| 6,574,868 | B1 | 6/2003 | Overholt | |
| 6,688,003 | B2 | 2/2004 | Scarla | |
| D494,437 | S | 8/2004 | Scarla | |
| D495,939 | S | 9/2004 | Ping | |
| D501,782 | S | 2/2005 | Ping | |
| 6,915,577 | B2 | 7/2005 | Scala | |
| D510,250 | S | 10/2005 | Ping | |
| 6,968,622 | B2 | 11/2005 | Ping | |
| 7,007,392 | B2 * | 3/2006 | Ping | 30/156 |
| 7,040,022 | B2 * | 5/2006 | Ping | 30/161 |
| 7,134,207 | B2 * | 11/2006 | Ping | 30/125 |
| 2002/0059730 | A1 | 5/2002 | Flavigny | |
| 2004/0020057 | A1 | 2/2004 | Hughes | |
| 2004/0045171 | A1 | 3/2004 | Moizis | |
| 2004/0103541 | A1 | 6/2004 | Scarla | |

FOREIGN PATENT DOCUMENTS

| | | |
|---|---|---|
| CN | 200420008852.7 | 3/2004 |
| CN | 200420020589.3 | 3/2004 |
| CN | 200420020590.6 | 3/2004 |
| CN | 200420020591.0 | 3/2004 |

* cited by examiner

FOLDABLE KNIFE

BACKGROUND

The present invention relates to a folding knife and more particularly to a foldable utility knife in which the blade may be folded into the handle when the knife is not in use. The application is an improvement over U.S. patent application Ser. No. 10/750,134 filed Dec. 13, 2003 and now U.S. Pat. No. 6,968,622 and Ser. No. 10/437,089 filed May 13, 2003 and now U.S. Pat. No. 7,040,022.

Utility knives have been in use for a number of years. Some of these utility knives have blades that are mounted on a blade holder which is foldable within a handle when the knife is not in use. However, some of these utility knives have many movable parts which makes them difficult to use and expensive to manufacture. In some of these utility knives replacement of the blade is a complicated operation which may require the use of special tools. In addition, some existing utility knives do not have means to support a finger when the knife is in use nor do they have adequate means to store extra blades.

OBJECTS

The present invention overcomes these problems and has for one its objects the provision of an improved utility knife in which the blade holder may be easily folded into the handle.

Another object of the present invention is the provision of an improved utility knife in which the blade is held securely on the blade holder.

Another object of the present invention is the provision of an improved utility knife in which improved means are provided for replacing the blade on the blade holder.

Another object of the present invention is the provision of an improved utility knife which is simple to use and inexpensive to manufacture and maintain.

Other and further objects of the invention will be obvious upon an understanding of the illustrative embodiment about to described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
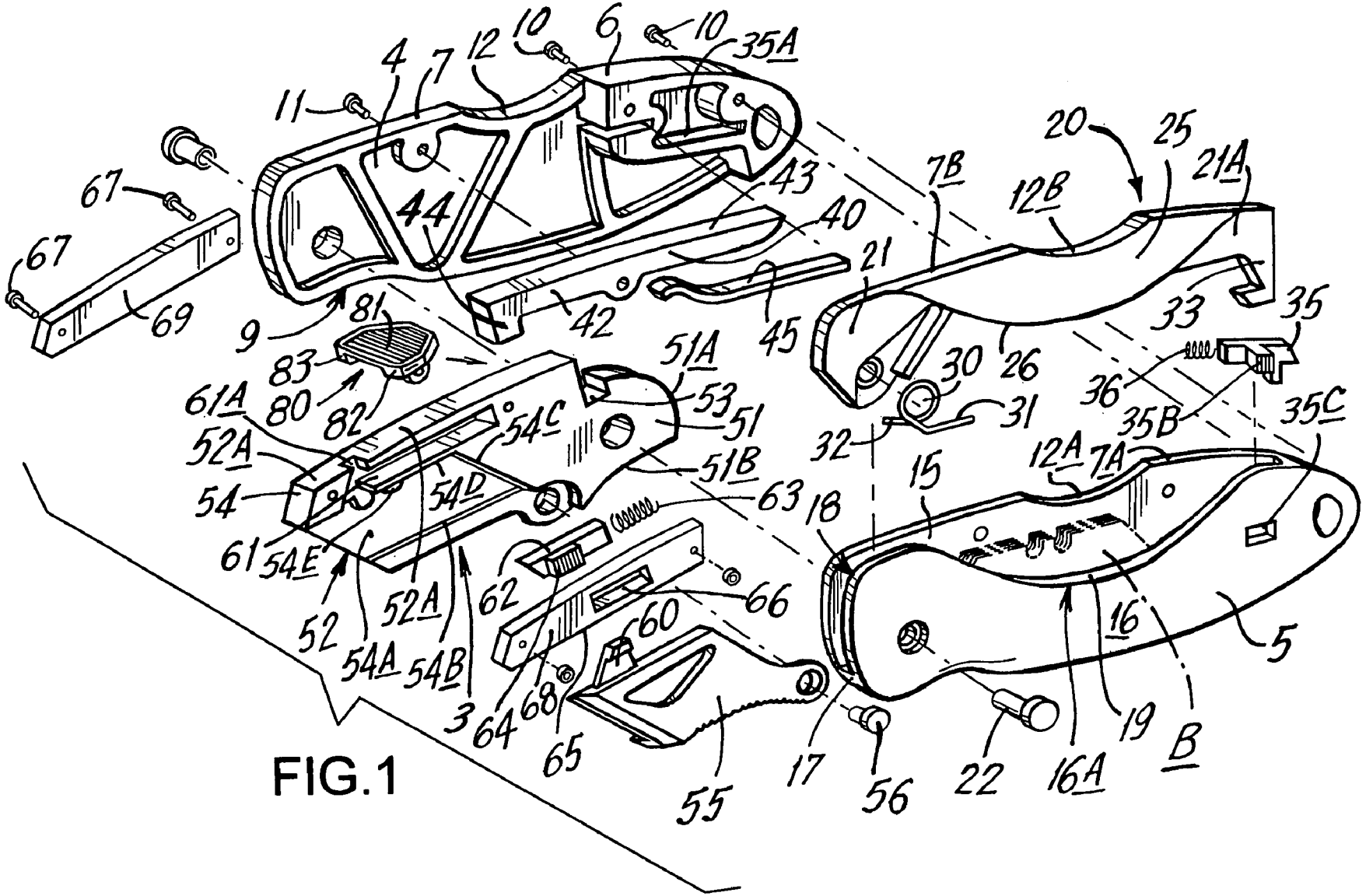
FIG. 1 is an exploded perspective view of a utility knife made in accordance with the present invention.
Figure 2:
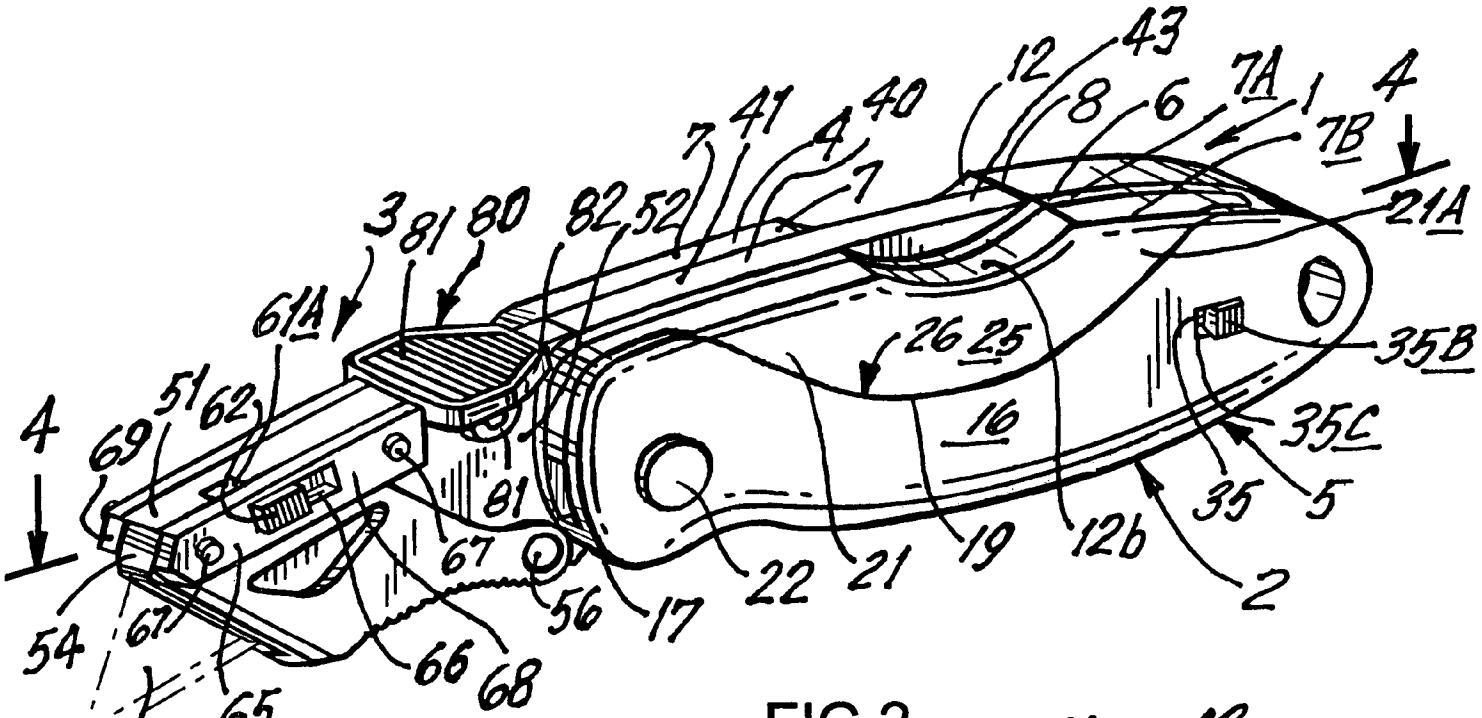
FIG. 2 is a perspective view of the utility knife of the present invention.
Figure 3:
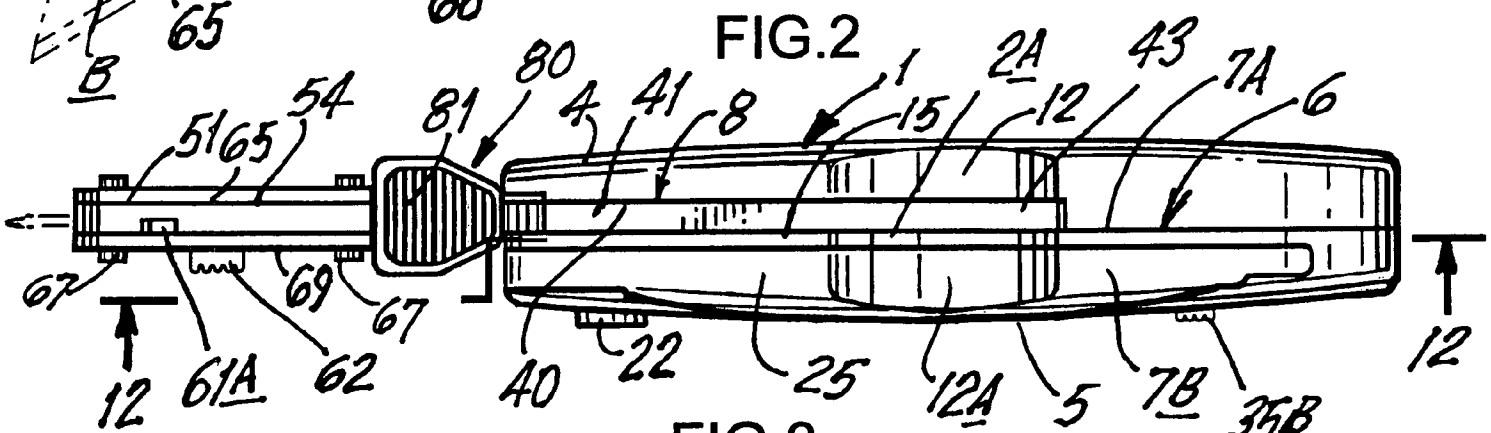
FIG. 3 is a top plan view thereof.

Referring to the drawings, the utility knife 1 of the present invention comprises a handle assembly 2 and a blade holder 3. The blade holder 3 is pivotally mounted on the handle 2 by means of a pivot assembly 22 from an open position to a closed position.

The handle assembly 2 comprises a side wall 4 having an upper edge 7 and a lower edge 9. A U-shaped blade storage compartment 5 having an inner wall 15 is provided and attached to the side wall 2 through the intermediation of a spacer 6 extending inwardly from side wall 4 and preferably integral therewith. The spacer 6 creates a space 8 (FIG. 4) between side wall 2 and the inner wall 15 of the blade storage compartment 5. The spacer 6, the side wall 2 and the blade holding compartment 5 are held together by fasteners 10 and 11 which extend through the spacer 6, the side wall 2 and the inner wall 15 of the blade holding compartment 5 in order to hold them together. The upper edge 7 of the side wall 2 has a finger notch 12 therein.

The blade storage compartment 5 is u-shaped and has a pair of spaced inner and outer walls 15 and 16, respectively, a bottom wall 17 connecting the inner and outer walls 15-16 together, and an open top 18. The upper edge 7A of the inner wall 15 is shaped similarly to and conforms with the shape of the upper edge 7 of the side wall 2 and has a notch 12A therein which preferably conforms in location, size and shape to the notch 12 in the side wall 2. The outer wall 16 has an upper edge 16A having a downwardly curved cut out to form a concave edge portion 19.

The open top 18 of the blade storage compartment 5 is adapted to be closed by a cover assembly 20 having a front portion 21 which is interposed between and pivotally mounted to the inner and outer walls 15 and 16 by means of a pivot assembly 22 and a rear portion 21A. The cover assembly 20 has a top surface 7B and a notch 12B which conform in location, shape and size to the top edges 7 and 7A and the notches 12 and 12A in the side wall 2 and the inner wall 15, respectively. A skirt 25 depends from the top surface 7B and has a lower curved convex edge 26 which conforms to and mates with a concave edge 19 in the outer wall 16 when the cover assembly 20 closes the blade storage compartment 5. A spring 30 having diverging arms 31 and 32 is mounted within the blade storage compartment 5 between inner and outer walls 15-16 and around the pivot assembly 22 with its arms 31 and 32 biased outwardly between the cover assembly 20 and the bottom wall 17 so that the spring 30 will normally raise the cover assembly 20 to open the blade storage compartment 5.

Figure 10:
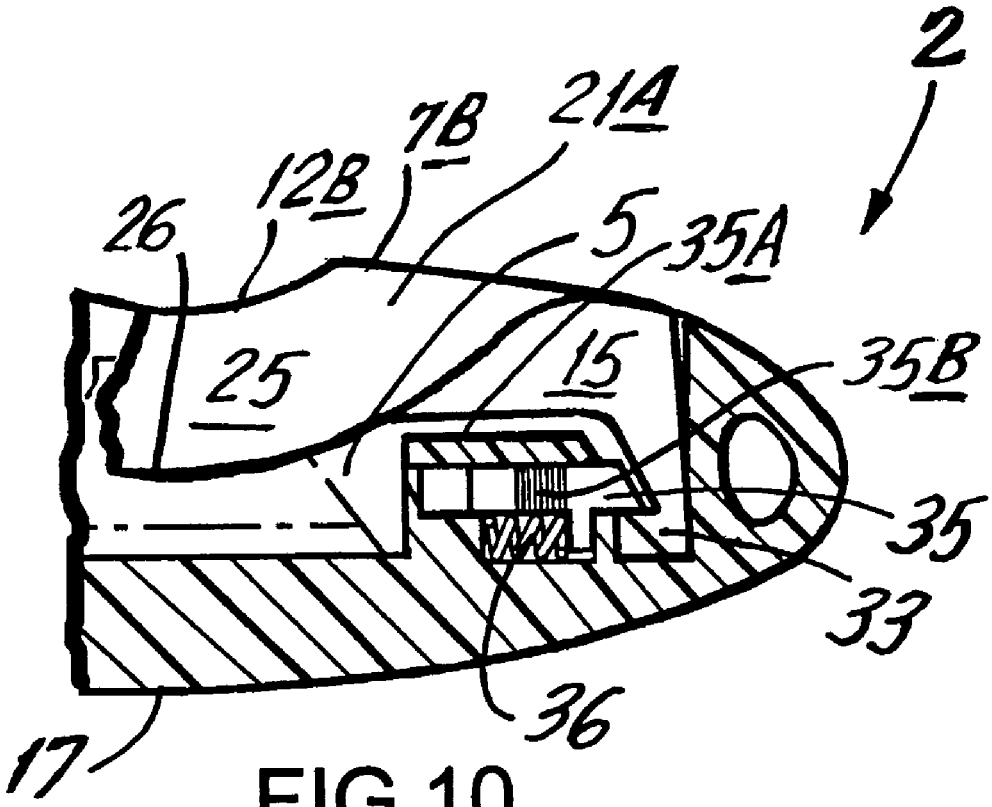
FIG. 10 is an enlarged fragmentary sectional view showing the storage compartment cover release mechanism in a locked cover closing position.
Figure 11:
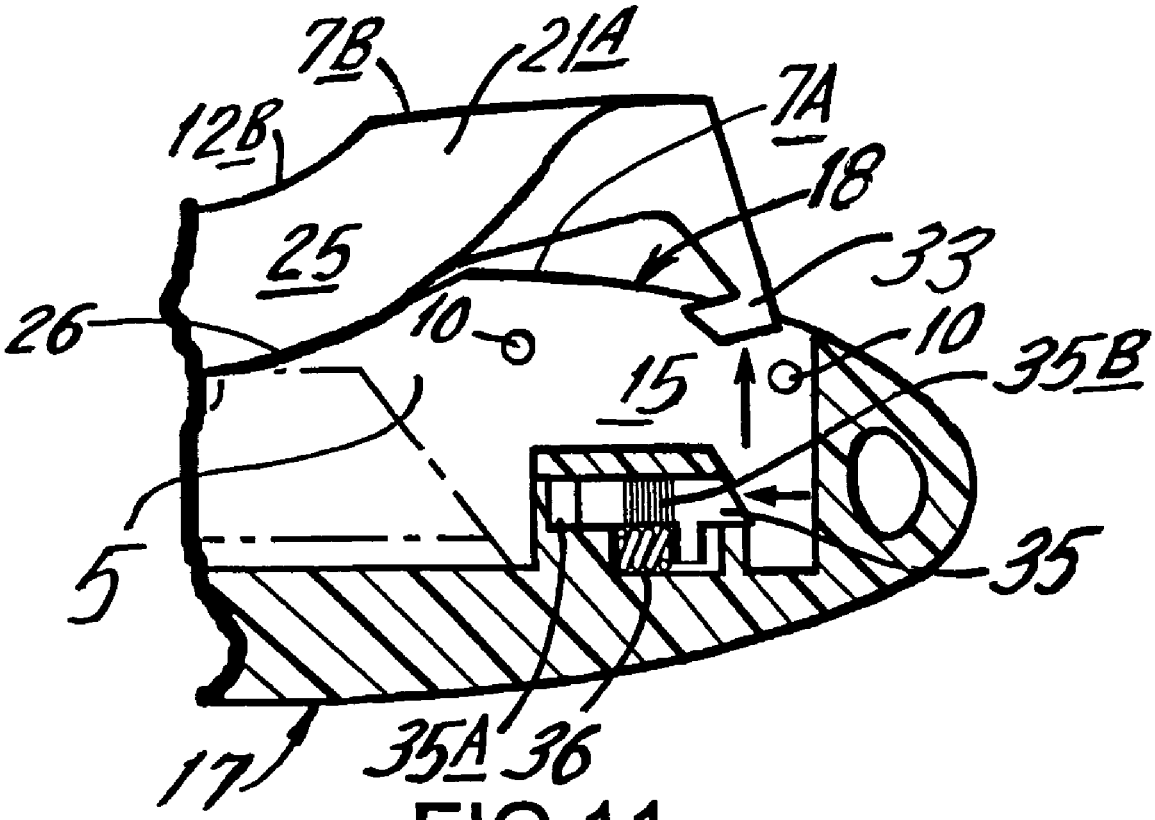
FIG. 11 is an enlarged fragmentary sectional view similar to FIG. 10 showing the storage compartment cover release mechanism in an unlocked cover opening position.

The rear portion 21A of the cover assembly 20 has a hook 33 extending downwardly therefrom. The spacer 6 has a spring pressed latch 35 slidably mounted in slot 35A which is normally biased toward the rear of the outer wall 16 by means of a spring 36. The latch 35 has a finger bottom 35B extending through an opening 35C in the outer wall 16. When the cover assembly 20 is in its closed position, the latch 35 is positioned over the hook 33 to keep the cover assembly 20 in it closed position (FIG. 10). When the latch 35 is moved by the finger button 35B against the spring 36 it is moved from beneath the hook 33 to release the cover assembly 20 to cause it to spring up under the influence of the spring 30 to open the blade storage compartment 5 (FIG. 11). To close the blade storage compartment 5, the cover 20 is moved down against the bias of the spring 30 until the hook 33 snaps under the latch 35 to hold the cover assembly 20 of the storage blade compartment 5 in a closed position. A plurality of blades B may be stored within the blade storage compartment 4 each of which can then be removed when it is desired to replace an old blade B with a new blade B.

Mounted in the space 8 formed between the side wall 2 and the inner wall 15 of the blade storage compartment 5 and along their upper edges 7 and 7A there is provided a lock lever assembly 40 which is pivotally mounted between the side wall 2 and the inner wall 15 on the pivot 11 which extends through the side wall 2, the inner wall 15 and the lock lever assembly 40. The lock lever assembly 40 is preferably a two arm lever having front and rear arms 42 and 43, respectively. The front arm 42 is provided with a downwardly extending lock finger 44. Below the rear arm 43 of the lock lever assembly 40 there is provided a leaf spring 45 which is mounted on the spacer 6 and which normally bears against the bottom edge of the rear arm 43 to force the rear arm 43 upwardly and the front arm 42 downwardly around the pivot 11 so that rear arm 43 normally protrudes above the notches 12, 12A and 12B in the side wall 2, inner wall 15 and top edge 7B, respectively. It will be seen that when the rear arm 43 of the lock lever assembly 40 is pressed down manually at the notches 12, 12A and 12B against the action of spring 45, the front arm 42 will be raised together with its lock finger 44.

The blade holder 3 of the present invention comprises a rear end 51 and a front end 52 which are preferably integral with each other. The blade holder 3 has a rear edge 51A, a bottom edge 51B and an upper edge 51C. The blade holder 3 is pivotally mounted in the space 8 between side wall 4 and inner wall 15 on the pivot pin assembly 22. The upper edge 51C has a groove 53 therein into which the downwardly extending lock finger 44 of the lock assembly 40 is adapted to enter when the blade holder 3 is in its extended or unfolded position.

The front end 52 of the blade holder 3 has an upper edge 52A and comprises a main wall 54 and a thin guard wall 55 movable relative to main wall 54 and preferably pivotally mounted on the main wall 54 on pivot pin 56. The main wall 54 has a blade holding area 54A having a top ledge 54D and a bottom ledge 54B and a rear ledge 54C and is adapted to hold a blade B which preferably comprises a lower cutting edge 57 seated on lower ledge 54C, rear edge 57A and top edge 59 abutting rear ledge 54C and top ledge 54D, respectively, and spaced notches 58 in its top edge 59 which enter into protrusions 54E in the upper ledge 54D. The movable guide wall 55 has a hook 60 extending upwardly therefrom. It will be seen that when the guard wall 55 is in its closed raised position it covers and holds the blade B in place but when the guard wall 55 is in its open downward position, it exposes the blade B to permit its removal and replacement.

The front end 52 is also provided with an elongated slot 61 located below its upper edge 53 and terminates in a space 61A above the slot 61. The hook 60 of the moveable guard wall 55 is adapted to enter the space 61A above the slot 60.

Figures 4, 5, 6, 7:
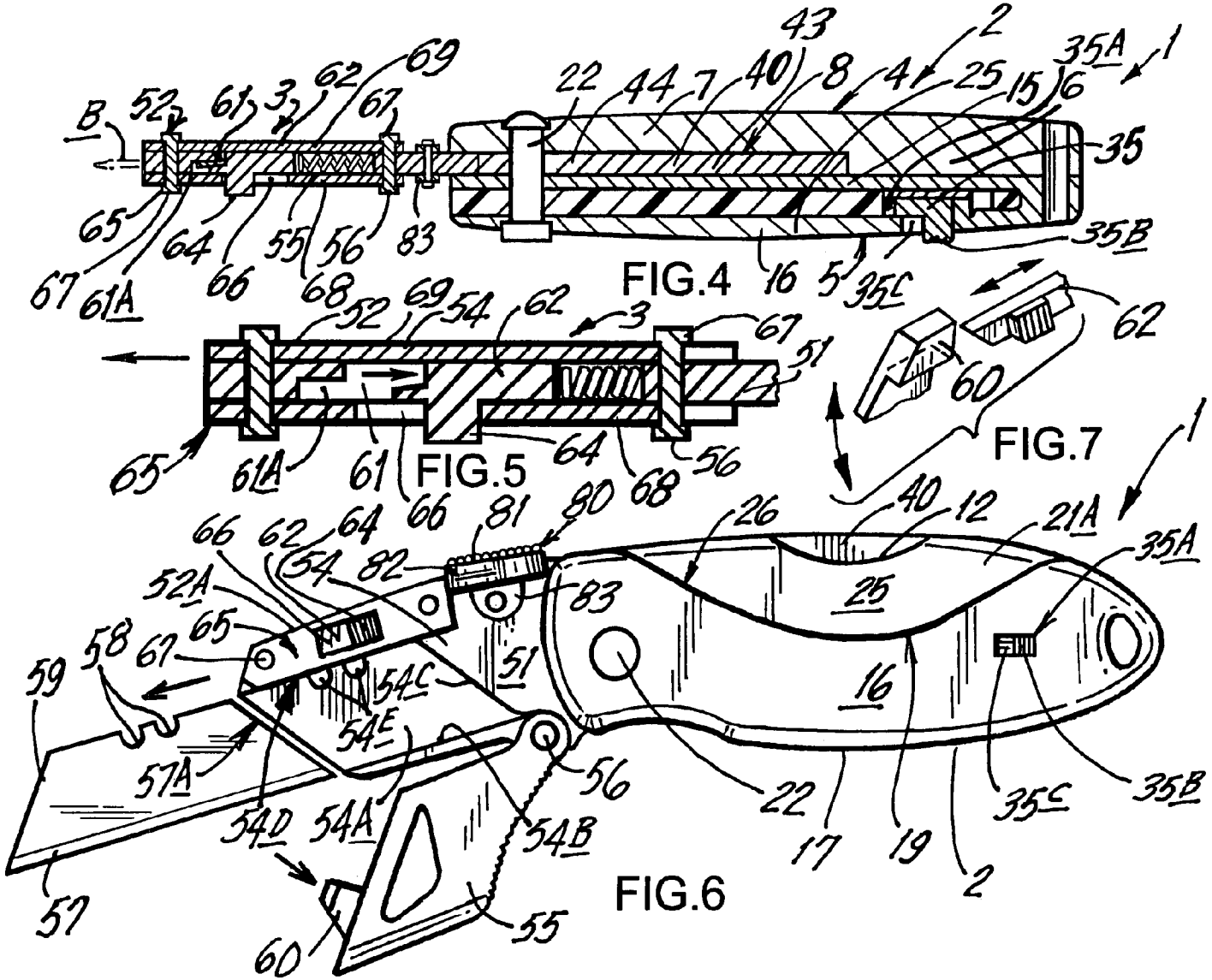
FIG. 4 is a sectional view taken along the line 4-4 of FIG. 2.
FIG. 5 is an enlarged sectional view of the blade locking mechanism of the present invention.
FIG. 6 is a side elevational view showing the blade being removed.
FIG. 7 is an enlarged perspective view of the blade locking mechanism of the present invention.
Figure 8:
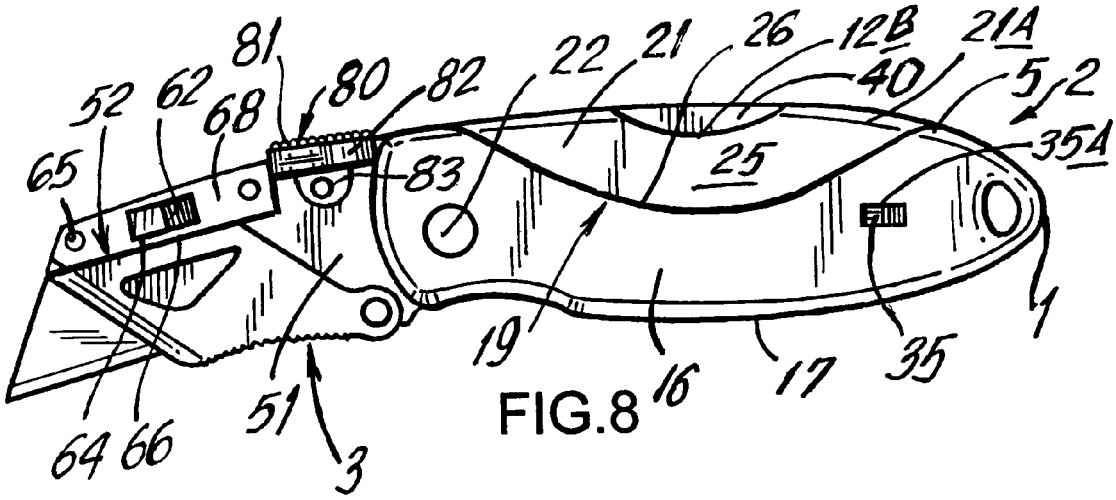
FIG. 8 is a side elevational view of the present invention showing the blade storage component in a closed position.
Figure 9:
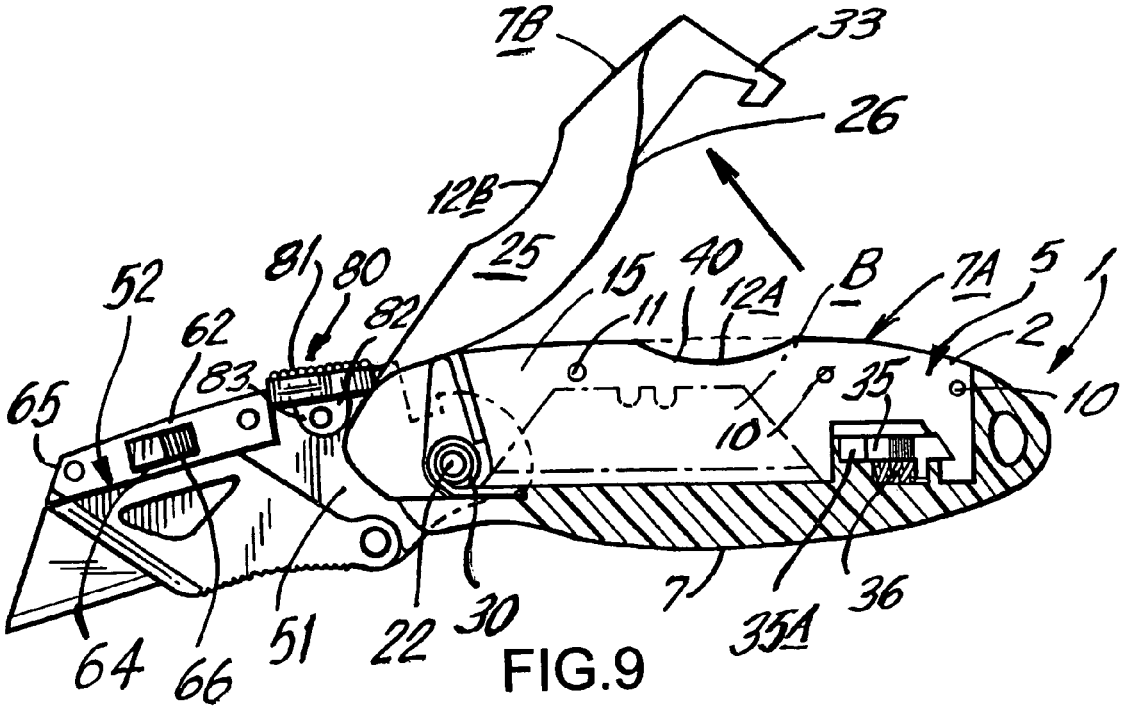
FIG. 9 is a view similar to FIG. 8 showing the blade storage compartment in an open position.

A blade lock assembly 65 is mounted along the upper edge 52A of the front end 52 of the blade holder 3. The blade lock assembly 65 comprises a pair of opposed side plates 68 and 69 mounted on opposite sides of the front end 52 adjacent the upper edge 52A by means of fasteners 67. The side plate 68 has a slot 66 which is alignment with and at the slot 61 in the front end 52. A lock finger 62 slidably mounted in slot 61 and is biased forwardly by a spring 63. The lock finger 62 has a side finger knob 64 extending through the slot 66 in the side plate 68. The lock finger 62 is adapted to be placed under the hook 60 when the guard wall is in its upper position to hold the guide wall 55 in its raised position, one main wall 54. When the lock finger 62 is moved back against the bias of spring 63 by means of the finger knob 64, it is moved out from under the hook 60 to release the guide wall 55 and permit it to pivot away from the main wall 54. Thus when it is desired to remove and replace the blade B, the lock finger 62 is moved away from under the hook 60 to release the guide wall 55. This permits the guard wall 55 to be pivoted relative to main wall 54 away from the blade B (as shown in FIG. 7) in order to expose the blade B and permit the blade B to be removed and replaced.

If desired, a finger support assembly 80 may be mounted on the upper edges 52A of the blade holder 3 and may comprise soft finger pad 81 mounted on a platform 82 and has a downwardly extending side walls 83 which are mounted on either side of the upper edge 52A of the blade holder 3. This finger support assembly 80 permits the user to bear down on the blade holder 3 with his finger without any danger of being injured.

In operation, the utility knife 1 is placed in its operative unfolded position with the blade holder 3 unfolded and ready to be used. The blade B is held between the main wall 54 and the guard wall 55 of the blade holder 3 by protrusions 54E extending into notches 58 in the top edge 59 of the blade B and between ledges 54B, 54C and 54D. The hook 60 on guard wall 55 is in place in the space 61A and the slide lock 62 is under the hook 60 to hold the guard wall 55 in position over the main wall 54. The lock finger 44 of the front arm 42 of the lock lever assembly 40 is in its lower position (because of the pressure of spring 45 on rear arm 43) and is positioned in the groove 53 in the blade holder 3 in order to hold the blade holder 3 in its unfolded position. The rear arm 43 of the lock lever assembly 40 is in its raised position and protrudes above the finger notches 12, 12A, and 12B in the top edges 7, 7A and 7B of the handle 2.

Figure 12:
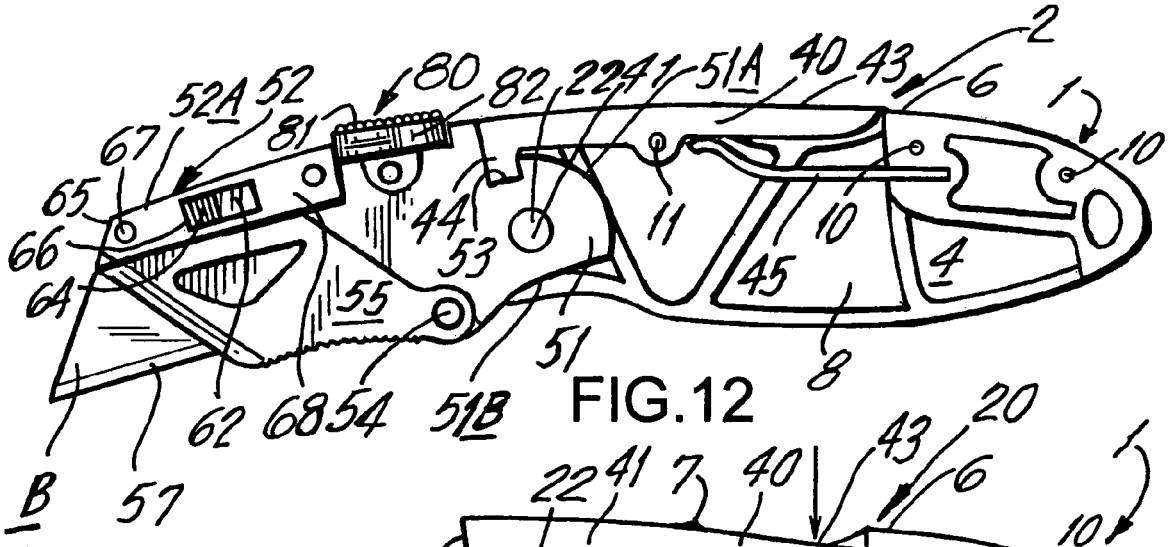
FIG. 12 is a sectional view taken along line 12-12 of FIG. 3 showing the utility knife in an open position.

When it is desired to place the utility knife 1 into its folded inoperative position, the rear arm 43 of the lock lever assembly 40 is pressed down manually at the notches 12, 12A, and 12B against the bias of the spring 45. This causes the front arm 42 of the lock assembly 40 to be raised thereby moving the lock finger 44 out of the groove 53 to release the blade holder 3 and permit it to pivot downwardly around the pivot pin 22 (FIG. 12). If desired, this may be accomplished by pushing down on the finger support assembly 80. The blade holder 3 is then pivoted down completely and is moved into the space 8 between the side wall 2 and the inner wall 15 (FIGS. 13 and 14) When pressure on rear arm 43 of the lock lever assembly 40 is released, the spring 45 moves the rear arm 40 back to its original raised position. This causes the lock finger 44 to bear against the rear edge 51A and lower edge 51B of the blade holder 3 (FIG. 13) thereby assisting in holding the blade holder 3 in its folded position.

Figure 13:
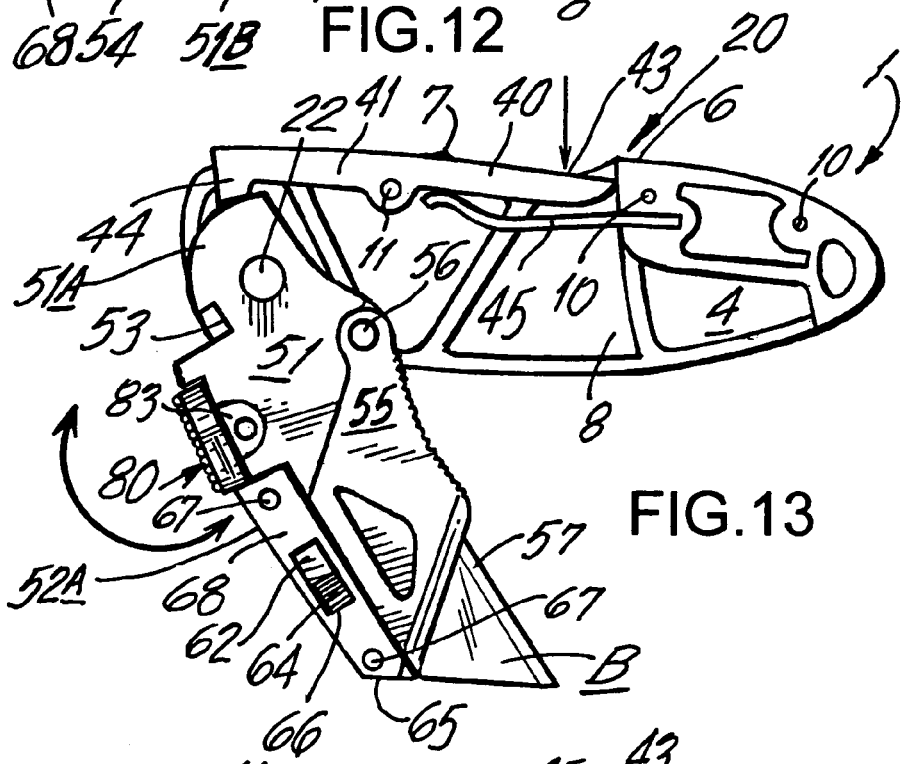
FIG. 13 is a sectional view similar to FIG. 12 showing the utility knife a partially folded position.
Figure 14:
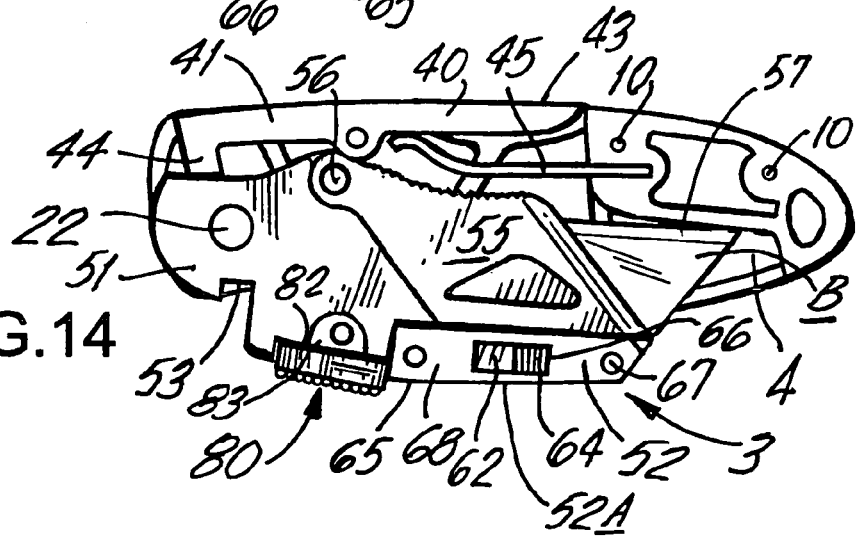
FIG. 14 is a sectional view similar to FIG. 12 showing the utility knife in a fully folded position.
Figure 15:
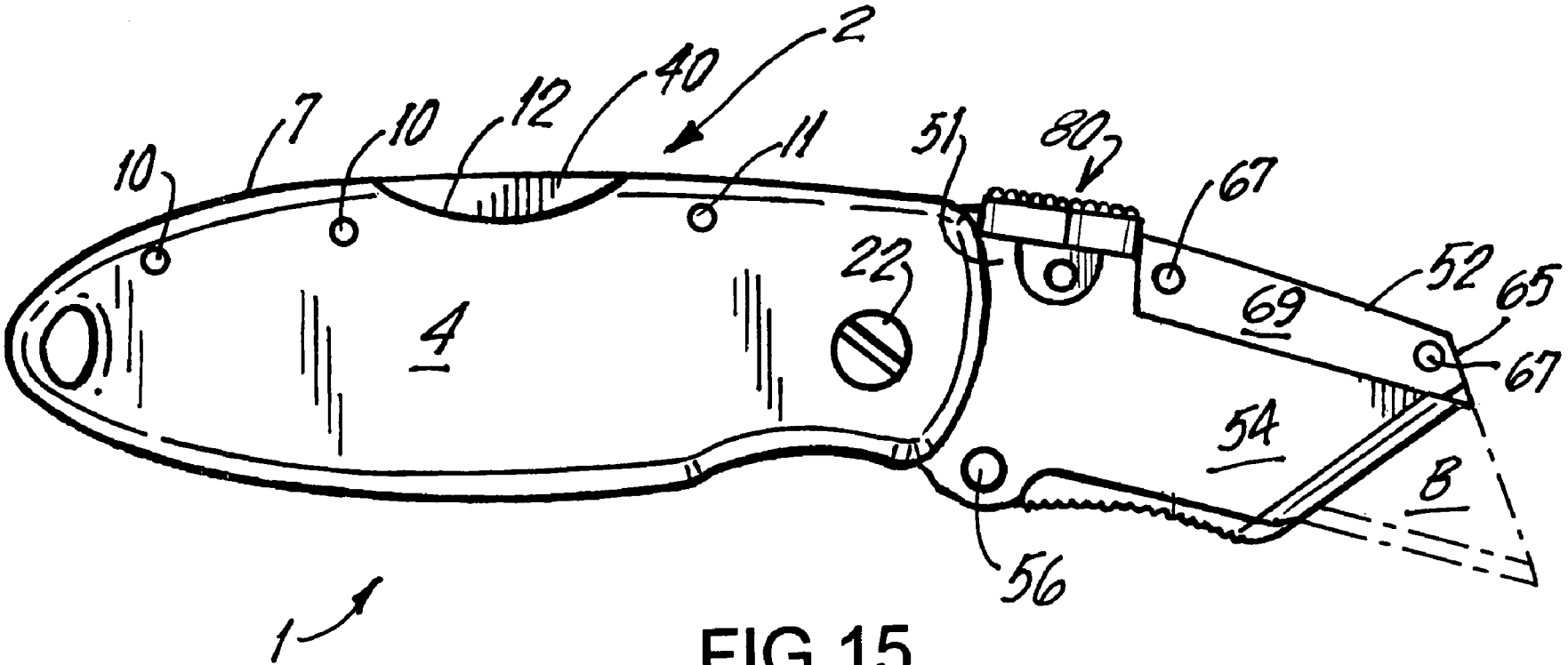
FIG. 15 is a plan view of the opposite side of the utility knife.

When it is desired to use the blade B, the reverse procedure is followed. The blade holder 3 is pivoted in the opposite direction (again with the use of finger support assembly 80, if desired). It may be desirable for the rear arm 43 of the lock lever assembly 40 to again be depressed manually at the notches 12, 12A, and 12B to assist in unfolding the blade holder 3. The blade holder 3 is continued to be rotated counter-clockwise (as seen in FIG. 13) until the lock finger 44 of the front arm 42 enters into the groove 53 in the rear end 51 of the blade holder 3 in order to hold the blade holder 3 in its extended position.

When it is desired to replace a blade B, the blade holder 3 is placed in its unfolded position (as shown in FIG. 4 to 6) and the slide lock 62 is moved back from under the hook 60 (by finger knob 64) against the action of the spring 63 thereby the releasing of guard wall 55 and permitting it to be pivoted downwardly relative to main wall 54 around pivot 56 to expose the blade B. The blade B can then be moved out of the blade holder 3 and a new blade B can be placed therein. After replacement, the guard wall 55 is again pivoted upwardly back into position over the blade B. The lock 60 is moved in the space 61A in the front of the slot 61. The slide lock 62 moves forward by spring 62 to a position beneath lock 60 to lock the guard wall 55 in position over the main wall 54.

The new blade B can be obtained from stored blades B in the blade storage compartment 4 which is opened by moving the latch 35 away from the hook 33 to permit the cover 20 of the blade storage compartment 4 to spring open under tension of spring 30. A blade B can then be removed from the blade storage compartment 4 and placed in the blade holder 3 as set forth above. The blade storage compartment 4 can then be closed by moving it down against bias of spring 30 until the spring pressed latch 35 enters the hook 33 to hold the cover 20 assembly in its closed position.

It will be seen that the present invention provides a utility knife in which the blade holder may be easily folded into a handle in which improved means are provided for securing the blade on the utility knife, for replacing the blade on the knife and which is simple to use and inexpensive to manufacture and maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privledge is claimed are defined as follows:

1. A utility knife comprising a handle and a blade holder, said blade holder being pivotally mounted on said handle for movement from an unfolded position to a folded position, said handle having a space adapted to receive at least a portion of said blade holder when the blade holder is in its folded position, said blade holder having a main wall and a guard wall movable relative to said main wall, means for holding a blade therebetween, and means for maintaining the guard wall adjacent to said main wall, said maintaining means comprises hook means on said guard wall, and lock means on said blade holder adapted to cooperate with said hook means to hold the guard wall in a position over said main wall, said lock means comprises a blade lock assembly mounted on said blade holder, said blade lock assembly comprises a slide lock adapted to be positioned under said hook means and adapted to be moved from under said hook means to release said guard wall for movement relative to said main wall.

2. A utility knife as set fort in claim 1, wherein the blade holding means comprise a pair of protrusions on the main wall of the blade holder, said protrusions being adapted to enter corresponding grooves in the blade.

3. A utility knife is set forth in claim 2, wherein said blade holding means comprises a ledge on said main wall adapted to hold the blade on said main wall.

4. A utility knife as set forth in claim 3, wherein said guard wall is moveable from an open position to a closed position overlying said main wall.

5. A utility knife as set forth in claim 1 wherein said blade lock assembly comprises a slot in said blade holder and wherein said slide lock is slidably mounted in said slot.

6. A utility knife as set forth in claim 5, wherein said blade lock assembly comprises a pair of plates mounted on each side of the blade holder and wherein a slit is provided in one of said plates communicating with said slot.

7. A utility knife as set forth in claim 6 wherein said slide lock has a knob extending into said slit.

8. A utility knife as set forth in claim 7 wherein said blade holder comprises a rear end and a front end, said front end comprising said guard wall and said main wall, said rear end being pivotally mounted to said handle and having upper and bottom edges.

9. A utility knife as set forth in claim 8 wherein said blade lock assembly is mounted on said front end adjacent to said upper edge.

10. A utility knife as set forth in claim 9 wherein said guard wall is pivotally mounted to said main wall.

11. A utility knife as set forth in claim 10 wherein said handle has a pivoted lock lever assembly mounted in the said space in the handle and wherein said lock lever assembly has a front arm and a rear arm and a lock finger extending from its front arm.

12. A utility knife as set forth in claim 11 wherein said blade holder has a groove therein adapted to receive said lock finger when the blade holder is in its unfolded position.

13. A utility knife as set forth in claim 12 wherein spring means are mounted beneath the rear arm of the lock lever assembly to bias the rear arm upwardly and to bias the front arm downwardly to permit the lock finger to enter the groove, whereby depressing the rear arm against the tension of the spring means will cause the front arm to rise and the lock finger to move out of the groove permitting the blade holder to pivot relative to the handle from an unfolded position to a folded position into the space in the handle.

14. A utility knife as set forth in claim 13, wherein said handle has a side wall, having a notch in its top edge and wherein the rear arm protrudes above the notch whereby depression of the rear arm at the notch permits the front arm to be raised upwardly and cause the lock finger to move out of the groove in the blade holder.

* * * * *